US008522687B2

(12) United States Patent
Liu

(10) Patent No.: US 8,522,687 B2
(45) Date of Patent: Sep. 3, 2013

(54) KINETIC ENERGY PENETRATOR

(76) Inventor: Shaiw-Rong Scott Liu, Arcadia, CA (US)

( * ) Notice: Subject to any disclaimer, the term of this patent is extended or adjusted under 35 U.S.C. 154(b) by 0 days.

(21) Appl. No.: 12/672,575

(22) PCT Filed: Sep. 5, 2008

(86) PCT No.: PCT/US2008/075354

§ 371 (c)(1),
(2), (4) Date: Feb. 8, 2010

(87) PCT Pub. No.: WO2009/032989

PCT Pub. Date: Mar. 12, 2009

(65) Prior Publication Data

US 2011/0023745 A1 Feb. 3, 2011

Related U.S. Application Data

(60) Provisional application No. 60/970,331, filed on Sep. 6, 2007.

(51) Int. Cl.
*F42B 12/08* (2006.01)

(52) U.S. Cl.
USPC ..... 102/519; 102/517

(58) Field of Classification Search
USPC ..... 102/517, 519, 518
See application file for complete search history.

(56) References Cited

U.S. PATENT DOCUMENTS 4,353,305 A * 10/1982 Moreau et al. ..... 102/519
4,498,395 A * 2/1985 Kock et al. ..... 102/517
4,836,108 A * 6/1989 Kegel et al. ..... 102/306
4,872,409 A * 10/1989 Becker et al. ..... 102/517
4,885,031 A * 12/1989 Spencer et al. ..... 75/248
5,064,462 A * 11/1991 Mullendore et al. ..... 75/248
5,097,766 A 3/1992 Campoli et al.
5,476,531 A * 12/1995 Timm et al. ..... 75/240
5,760,317 A * 6/1998 Kapoor ..... 75/248
5,872,327 A * 2/1999 Taal et al. ..... 102/506
5,913,256 A 6/1999 Lowden et al.
6,010,580 A * 1/2000 Dandliker et al. ..... 148/403
6,186,072 B1 2/2001 Hickerson, Jr. et al.
6,845,719 B1 * 1/2005 Spencer ..... 102/519
6,911,063 B2 * 6/2005 Liu ..... 75/236
7,270,060 B1 * 9/2007 Manole et al. ..... 102/521
8,361,178 B2 * 1/2013 Liu et al. ..... 51/309

OTHER PUBLICATIONS

International Search Report and Written Opinion in counterpart PCT application No. PCT/US08/075354, dated Nov. 19, 2008.

* cited by examiner

*Primary Examiner* — James Bergin
(74) *Attorney, Agent, or Firm* — Chen Yoshimura LLP

(57) ABSTRACT

A kinetic energy penetrator includes an elongated main body, a conical tip joined to the main body at the front end thereof, and fins located at the tail end of the main body. The tip is made of a hardmetal material which comprises hard particles including a first material and a binder matrix including a second, different material. A volume of the second material is from 3% to 40% of total volume of the hardmetal material. The hard particles include carbides, nitrides, carbonitrides, or borides, or combinations thereof. The binder matrix includes Re, a Ni-base superalloy, Ni, Co, W, Ta, or Mo, or combinations thereof. The main body is made of a high density metal or alloy (Density>16.0 g/cc), such as pure W, W—Re alloy, W—Mo alloy, W—Mo—Re alloy, W—Ni alloy, W—Co alloy, W—Ni—Fe alloy, W—Ni—Co—Fe alloy, depleted U.

11 Claims, 1 Drawing Sheet

KINETIC ENERGY PENETRATOR

This application claims priority from U.S. Provisional Patent Application No. 60/970,331, filed Sep. 6, 2007, which is herein incorporated by reference in its entirety.

BACKGROUND OF THE INVENTION

1. Field of the Invention

This invention relates to a kinetic energy penetrator.

2. Description of the Related Art

A kinetic energy penetrator is a type of ammunition which uses kinetic energy to penetrate the target. Conventionally, a kinetic energy penetrator is made of an elongated rod-shaped body and a number of fins located at the tail end of the body. Background information of some kinetic energy penetrators is generally available to the public. For example, a Wikipedia entry on kinetic energy penetrator (http://en.wikipedia.org/wiki/Kinetic_energy_penetrator) describes the history and modern design of kinetic energy penetrators. An article published by Jane's Defense News describes the "RO Defence 120 mm tank gun ammunition" (http://www.janes.com/defence/news/jdw/jdw010108_4_n.shtml). Another article published by GlobalSecurity.org describes the "M829 120 mm, APFSDS-T" (http://www.globalsecurity.org/military/systems/munitions/m829a1.htm).

SUMMARY OF THE INVENTION

The present invention is directed to a kinetic energy penetrator that substantially obviates one or more of the problems due to limitations and disadvantages of the related art.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a kinetic energy penetrator which includes: a main body; a conical tip joined to the main body at a front end thereof; and a plurality of fins located at a tail end of the may body, wherein the tip is made of a hardmetal material.

The hardmetal material includes hard particles comprising a first material; and a binder matrix comprising a second, different material, a volume of the second material being from about 3% to about 40% of total volume of the hardmetal material. The hard particles include carbides, nitrides, carbonitrides or borides, or combinations thereof. The binder matrix includes Re, a Ni-base superalloy, Ni, Co, W, Ta or Mo, or combinations thereof.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1A:
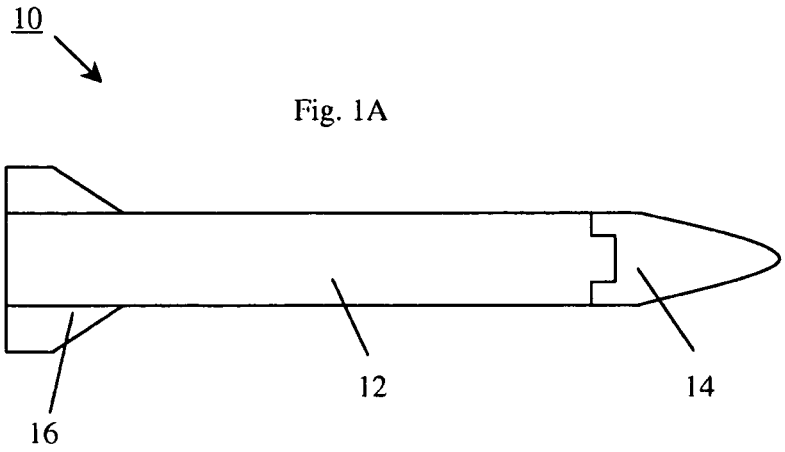
FIGS. 1A and 1B schematically illustrate the structure of a kinetic energy penetrator.
Figure 1B:
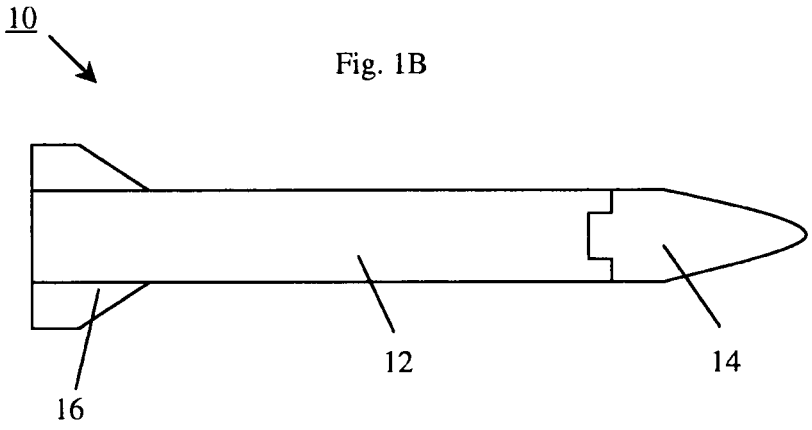

According to embodiments of the present invention, as shown in FIGS. 1A and 1B, a kinetic energy penetrator 10 includes an elongated main body 12, a conical tip 14 joined to the main body at the front end thereof, and fins 16 located at the tail end of the may body. The tip 14 and the main body 12 are preferably made of different materials. The main body 12 is made of a heavy material or materials to carry large kinetic energy. The tip 14 is made of a material that has high strength, high hardness, high toughness, and high resistances to deformation and erosion at high temperatures. Because of these material properties, the tip 14 is highly resistant to deformation at high temperatures, which minimizes the formation of mushroom head during penetration. Because the main body 12 is made of a heavy material, the tip needs not be high density (although it is desirable to have a high density tip as well).

According to embodiments of the present invention, the tip 14 of the kinetic energy penetrator 10 is made of a hardmetal material. The hardmetal material comprises: hard particles comprising a first material and a binder matrix comprising a second, different material, a volume of the second material being from about 3% to about 40% of total volume of the material.

The hard particles in the above material includes carbides (WC, $W_2C$, $Mo_2C$, TiC, TaC, NbC, HfC, ZrC, $Cr_2C_3$), and/or nitrides (TiN, ZrN, HfN, VN, TaN, NbN), and/or carbonitrides (Ti(C,N), Zr(C,N), Hf(C,N), V(C,N), Nb(C,N), Ta(C,N)), and/or borides ($TiB_2$, $TiB_2$, $ZrB_2$, $HfB_2$, $VB_2$, $NbB_2$, $TaB_2$, $MoB_2$, $WB_2$, $W_2B$). These materials can be used alone or in combination.

The binder matrix in the above material includes Re, and/or a Ni-base superalloy, and/or Ni, and/or Co, and/or W, and/or Ta, and/or Mo. These materials can be used alone or in combination.

Some of the above described hardmetal materials, in particular the ones that use Re or a Ni-based superalloy in the binder matrices, have been describe in a U.S. Pat. No. 6,911,063 B2, issued Jan. 28, 2005 ("the '063 patent"), which has common inventorship with the present application. As described in the '063 patent, the Ni-based superalloy as a binder material may be in a γ-γ' phase where the γ' phase with a FCC structure mixes with the γ phase. ('063 patent, col. 4, lines 23-25.) The '063 patent also describes methods for fabricating the hardmetal materials with Re or a Ni-based superalloy in binder matrices. In particular, such description can be found in col. 7, line 51 through col. 9, line 42 of the '063 patent. The disclosure of U.S. Pat. No. 6,911,063 B2 is herein incorporated by reference in its entirety. The hardmetal materials using other binder matrices may be fabricated in similar ways.

The main body of the kinetic energy penetrator is made of a high density metal or alloy (Density>16.0 g/cc). Examples of such high density metal or alloy include pure W, W—Re alloy, W—Mo alloy, W—Mo—Re alloy, W—Ni alloy, W—Co alloy, W—Ni—Fe alloy, W—Ni—Co—Fe alloy, depleted U, etc.

In an alternative embodiment, the main body 12 is also be made of the hardmetal materials described above. It can be made of the same material as the tip 14.

It will be apparent to those skilled in the art that various modification and variations can be made in the kinetic energy penetrator of the present invention without departing from the spirit or scope of the invention. Thus, it is intended that the present invention cover modifications and variations that come within the scope of the appended claims and their equivalents.

What is claimed is:

1. A kinetic energy penetrator comprising:

a main body;

a conical tip joined to the main body at a front end thereof; and a plurality of fins located at a tail end of the may body, wherein the tip is made of a hardmetal material which comprises:

hard particles comprising a first material; and a binder matrix comprising a second, different material, a volume of the second material being from about 3% to about 40% of total volume of the hardmetal material, wherein the binder matrix is selected from the group consisting of Re, a Ni-base superalloy, W, Ta and Mo.

2. The kinetic energy penetrator of claim 1, wherein the hard particles are selected from the group consisting of carbides, nitrides, carbonitrides and borides.

3. The kinetic energy penetrator of claim 2, wherein the carbides are selected from the group consisting of WC, $W_2C$, $Mo_2C$, TiC, TaC, NbC, HfC, ZrC and $Cr_2C_3$, wherein the nitrides are selected from the group consisting of TiN, ZrN, HfN, VN, TaN and NbN, wherein the carbonitrides are selected from the group consisting of Ti(C,N), Zr(C,N), Hf(C,N), V(C,N), Nb(C,N) and Ta(C,N), and wherein the borides are selected from the group consisting of $TiB_2$, $TiB_2$, $ZrB_2$, $HfB_2$, $VB_2$, $NbB_2$, $TaB_2$, $MoB_2$, $WB_2$ and $W_2B$.

4. The kinetic energy penetrator of claim 2, wherein the hard particles comprises WC.

5. The kinetic energy penetrator of claim 1, wherein the main body is made of a high density metal or alloy.

6. The kinetic energy penetrator of claim 5, wherein the density of the high density metal or alloy is greater than about 16.0 g/cc.

7. The kinetic energy penetrator of claim 5, wherein the high density metal or alloy are selected from the group consisting of pure W, W—Re alloy, W—Mo alloy, W—Mo—Re alloy, W—Ni alloy, W—Co alloy, W—Ni—Fe alloy, W—Ni—Co—Fe alloy and depleted U.

8. The kinetic energy penetrator of claim 7, wherein the high density metal or alloy comprises W—Ni alloy.

9. The kinetic energy penetrator of claim 5, wherein the binder matrix comprises Re, wherein the hard particles comprises WC, and wherein the high density metal or alloy comprises W—Ni alloy.

10. The kinetic energy penetrator of claim 1, wherein the main body is made of the same material as the tip.

11. The kinetic energy penetrator of claim 1, wherein the binder matrix comprises Re.

* * * * *